US005261332A

United States Patent [19]

Grandy

[11] Patent Number: 5,261,332

[45] **Date of Patent: * Nov. 16, 1993**

[54] RAILCAR ADAPTER

[75] Inventor: Robert S. Grandy, Hinsdale, Ill.

[73] Assignee: Unity Railway Supply Co., Inc., Bensenville, Ill.

[ * ] Notice: The portion of the term of this patent subsequent to Sep. 29, 2009 has been disclaimed.

[21] Appl. No.: 920,649

[22] Filed: Jul. 28, 1992

Related U.S. Application Data

[63] Continuation of Ser. No. 617,186, Nov. 23, 1990, Pat. No. 5,150,658.

[51] Int. Cl.[5] ..... B61F 5/32

[52] U.S. Cl. ..... 105/218.1; 105/225

[58] Field of Search ..... 105/218.1, 222, 223, 105/225; 384/42, 37, 10

[56] References Cited

U.S. PATENT DOCUMENTS

| | | | |
|---|---|---|---|
| 2,121,833 | 6/1938 | Sproul | 213/33 |
| 3,381,629 | 5/1968 | Jones | 105/218.1 |
| 3,397,653 | 8/1968 | Williams | 105/218.1 |
| 3,443,461 | 5/1969 | De Biasse | 384/37 X |
| 3,844,226 | 10/1974 | Brodeur et al. | 105/222 |
| 3,897,736 | 8/1975 | Tack | 105/222 X |
| 4,078,501 | 3/1978 | Neumann et al. | 105/218.1 X |
| 4,203,371 | 5/1980 | Tack | 105/218.1 X |
| 4,428,303 | 1/1984 | Tack | 105/218.1 X |
| 4,785,740 | 11/1988 | Grandy | 105/225 |
| 4,890,937 | 1/1990 | Balsells | 384/37 X |
| 4,906,109 | 3/1990 | Balsells | 384/37 X |

*Primary Examiner*—Joseph D. Pape
*Attorney, Agent, or Firm*—Edward D. Gilhooly, Ltd.

[57] ABSTRACT

A railcar adapter for the side frame pedestal of the truck assembly for a railcar. The adapter creates a clearance with the inboard and outboard lugs of the pedestal side frame to permit lateral movement of the adapter relative to the side frame. Plugs of a solid lubricant are provided on the crown of the adapter to facilitate movement.

6 Claims, 1 Drawing Sheet

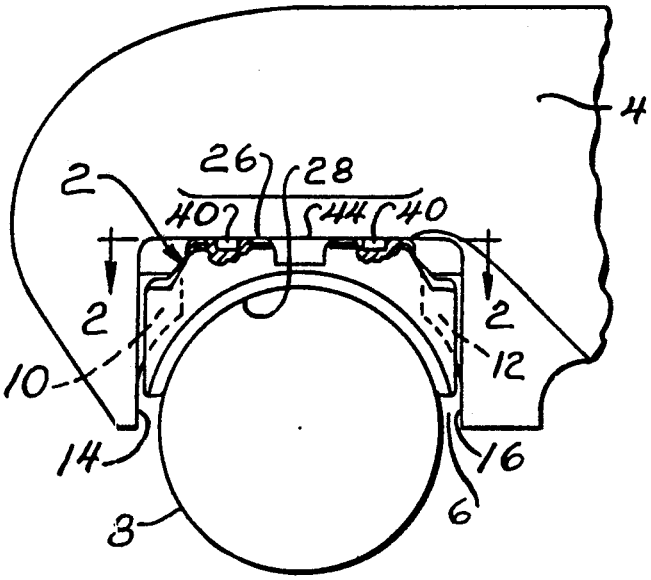
FIG. 1
FIG. 2
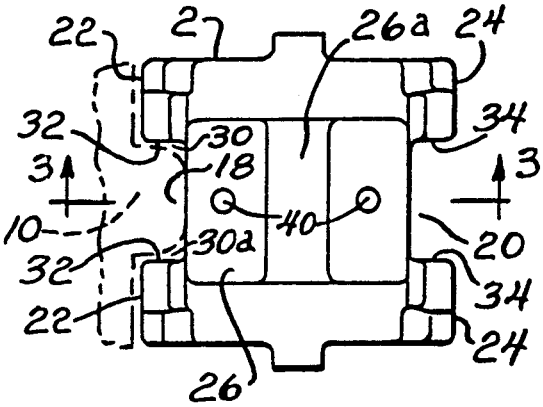
FIG. 4
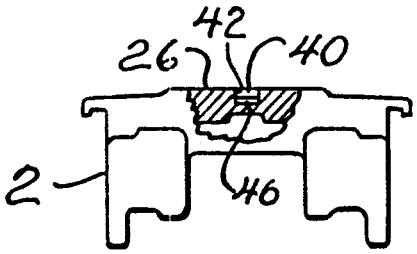
FIG. 3
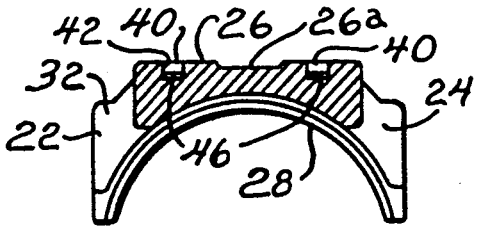
FIG. 5
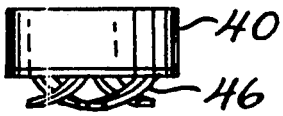

RAILCAR ADAPTER

This is a continuation of co-pending application Ser. No. 617,186, filed Nov. 23, 1990, now U.S. Pat. No. 5,150,658.

BACKGROUND OF THE INVENTION

1. Field of the Invention

This invention relates to the side frame structure of a railcar truck assembly and more particularly, to an improved bearing adapter.

2. Description of Prior Art

The truck assembly of a railcar typically includes a pair of side frames on each side having downwardly opening jaws. A bearing adapter is vertically movable within the jaw and rests on a roller bearing that rotatably carries a wheel axle. The bearing adapter is mounted on a side frame by a mating lug arrangement to inhibit movement in other directions within the jaw.

It is long been an objective to support the adapters on the side frames with minimum lateral clearance to prevent relative movement between the truck and car frame. Such elimination of lateral movement of the adapter was intended to provide better wear characteristics and other alleged design advantages. Accordingly, prior traditional designs for adapter castings used in truck assemblies have stressed the benefits of minimizing lateral movement of the adapter relative to the side frame, as it sits upon the roller bearing, to the extent possible for optimum truck operation.

In recent years, however, the advantages of uncoupling the wheel set from the railcar body have become recognized in the railcar industry. Accordingly, there is a important need to provide means for effectively accomplishing such a uncoupling effect in rail cars as now found desirable.

SUMMARY OF THE INVENTION

It is therefore an objective of the invention to provide an improved adapter for enhancing the mounting of a railcar on the truck assembly. The adapter herein disclosed sits upon the roller bearing/axle/wheel assembly with the capability of undergoing greater lateral movement than provided by prior art castings. The increase in lateral movement associated with the adapter of the invention insures significantly improved carbody bebavior when moving over tangent or curved track. Lateral movement of the adapter within the jaw also reduces car body-induced lateral acceleration, reduction of which minimizes freight car structure fatigue, and also minimizes wheel flange wear, rail head wear and certain freight component wear. The uncoupling effect of the wheel provided by the invention will additionally reduce derailment tendencies, because the wheel set of the truck assembly will be better able to steer itself.

The adapter of the application is provided with a novel friction reducing technique on its crown to enhance lateral movement as desired and also reduce the wear normally occurring at the mating surfaces of the adapter crown and side frame pedestal roof. The benefits of the invention with enhanced movement are accomplished with an improved adapter without the requirement of additional appurtenances of any type for efficiency and economical railcar assembly and operation.

BRIEF DESCRIPTION OF THE DRAWINGS

FIG. 1 is a partial side elevational view of a pedestal side frame of a railcar having the improved bearing adaptor of the invention;

FIG. 2 is a top plan view of the bearing adapter of the invention shown in FIG. 1;

FIG. 3 is a side sectional view of the bearing adapter of FIG. 2 taken along lines 3—3 of FIG. 2;

FIG. 4 is an end elevational view, with parts broken away in section, of the bearing adapter of FIG. 2; and FIG. 5 is a side elevational view of the plug of lubricating material with a resilient spring utilized with the bearing adapter of FIG. 2.

DESCRIPTION OF A PREFERRED EMBODIMENT

Referring now to FIGS. 1-5, there is illustrated the improved bearing adapter of the invention, generally designated by reference numeral 2. The adapter 2 is manufactured from a metal by any suitable process, such as, for example, by casting and the like. In FIG. 1, the adapter 2 is mounted on the pedestal side frame 4 within the downwardly opening jaw 6. The adapter 2 is arranged to sit on a bearing unit 8 and is vertically movable within the opening of jaw 6 in a manner well known. Although only one jaw 6 and bearing unit 8 are illustrated in FIG. 1, it should be apparent to one skilled in the art that each pedestal side frame 4 includes a pair of jaws 6 having such components.

A pair of opposed lugs 10 and 12, constituting the outboard and inboard lugs, are formed on the vertical walls 14 and 16 of the jaw 4. As best seen in FIG. 2, adapter 2 is provided with channels 18 and 20, which are defined by opposed pairs of adapter lugs 22 and 24, that respectively engage lugs 10 and 12 and permit relative vertical movement within the jaw 4. The body of adapter 2 includes a crown or upper surface 26 of slightly convex design, except for a groove 26a extending across crown 22 (FIGS. 2 and 3). A saddle-like bottom 28 of adapter 2 provides a concave surface having a constant radius to sit on the upper portion of bearing unit 8 which is operatively connected to the axle (not shown) in a conventional manner.

Clearances or spacings 30, **30*a* are provided between the opposed inner lateral surfaces 32 and 34 of adapter lugs 22 and (24) lugs and the respective confronting surface of outboard and inboard lugs 10 and 12 of the pedestal jaw 4 (See FIG. 2). Such clearances 30, 30*a* between adapter 2 and the pedestal lugs 10 and 12 permit lateral movement of the adapter 2 relative to side pedestal 4 or, in effect, a degree of uncoupling of the truck assembly from the railcar. The uncoupling effect of the truck assembly through greater lateral movement of the adapter 2** of the invention provides better car behavior over curved track, reduced lateral body accelerations for minimizing car wear, improved ride characteristics and reduction of derailment tendencies among numerous benefits.

The lateral movement of the bearing adapter 2 herein disclosed relative to the jaw 4 is facilitated by novel low friction assemblies provided in the body of the adapter 2. Each low friction assembly includes a plug 40 which is fabricated from a material demonstrating low frictional properties. The plug 40 may be cylindrical in configuration as shown in FIGS. 2 and 5 or formed in other shapes (not shown) which are found suitable in use. As seen in FIG. 2, two plugs 40 are oriented in exposed external relationship in holes 42. The holes 42 are drilled in the surface of crown 26 and extend downward for a selected depth. Although two separate plugs 40 are shown, one, or more than two plugs 40, can also be employed if providing relatively unrestricted lateral movement of adapter 2 to the limited extent contemplated. The material of plugs 40 may constitute any low frictional material capable of providing a low frictional interface or lubrication between crown 26 and the roof 44 of the side frame 4 in jaw 6.

An example of one compound capable of forming plug 40 and exhibiting the desired low frictional characteristic is a solid lubricant which is sold under the trademark Century Stiklube L. C. F. and is distributed by Century Oils (Canada) Inc. Other low frictional material having similar properties may also be used to form plug 40, if desired. The plugs 40 of the solid lubricant heretofore described provides continuous lubrication to the mating surfaces of the adapter crown 26 and side frame pedestal roof 44 with or without a pedestal roof liner wear plate. The presence of adequate lubrication is insured by the invention by providing a biasing element, such as spring 46 as best shown in FIG. 5, within the bole 42 of the adapter 2 urging the plug 40 upward. The plugs 40 provide a well dispersed lubrication over the crown surface 26 and the pedestal side frame roof 44 through the wiping action on the plugs 40 occurring during relative lateral movement of the adapter 2 and side frame 4.

What is claimed is:

1. A bearing adapter for a railcar pedestal side frame having outboard and inboard lugs and a roof comprising an adapter body having an upper crown and a lower saddle for contacting a bearing element, said adapter body having a pair of opposed spaced lugs defining tracks for the outboard and inboard lugs of the pedestal side frame, said adapter body having means for permitting lateral movement of said adapter body relative to the roof of said pedestal side frame, said upper crown having a surface for contacting the pedestal side frame, said upper crown includes lubrication means for facilitating relative lateral movement between said adapter body and the roof of said pedestal side frame, said lubrication means being embedded beneath said at least one surface and having a portion exposed at said surface for reducing the friction of said surface, and said lubrication means releasing a lubricant over said surface through wiping action between said surface and the pedestal side frame during lateral movement.

2. The bearing adapter according to claim 1 wherein said lubrication means comprises at least one element formed from a low frictional material, said element having a portion being externally exposed on said upper crown, said at least one element being disposed in at least one hole within said adapter body.

3. The bearing adapter according to claim 2 wherein said at least one element comprises at least one plug of a solid lubricating material.

4. The bearing adapter according to claim 3 wherein said at least one plug comprises a plurality of separate plugs being disposed in a respective hole and having a portion exposed through said upper crown.

5. The bearing adapter according to claim 3 further comprising resilient means disposed in said hole of said body adjacent said at least one element, said resilient means acting to urge said at least one element upward to compensate for wear.

6. A bearing adapter for a railcar pedestal side frame having outboard and inboard lugs and a roof comprising an adapter body having an upper crown and a lower saddle for contacting a bearing element, said adapter body having a pair of opposed spaced lugs defining tracks for the outboard and inboard lugs of the pedestal side frame, said adapter body having means for permitting lateral movement of said adapter body relative to the roof of said pedestal side frame, said upper crown having a surface for contacting the pedestal side frame, said upper crown including lubrication means exposed on said surface for facilitating relative lateral movement between said adapter body and the roof of said pedestal side frame, and said means for permitting lateral movement between said adapter body and the pedestal side frame is provided by the distance between said opposed spaced lugs being greater than the distance between the outboard and inboard lugs of the pedestal side frame for creating a clearance for said lateral movement.

* * * * *